United States Patent [19]

Yunan

[11] Patent Number: 4,799,428

[45] Date of Patent: Jan. 24, 1989

[54] EXPLOSIVE PRIMER UNIT FOR INSTANTANEOUS INITIATION BY LOW-ENERGY DETONATING CORD

[75] Inventor: Malak E. Yunan, Boonton Township, Morris County, N.J.

[73] Assignee: Explosives Technologies International Inc., Wilmington, Del.

[21] Appl. No.: 35,004

[22] Filed: Apr. 6, 1987

[51] Int. Cl.[4] ..... C06C 5/04; F42B 3/10; F42D 1/08

[52] U.S. Cl. ..... 102/322; 102/275.3; 102/275.12

[58] Field of Search ..... 102/304, 313-315, 102/318, 320, 322, 312, 331, 275.3, 275.4, 275.5, 275.12

[56] References Cited

U.S. PATENT DOCUMENTS

| | | | |
|---|---|---|---|
| Re. 30,621 | 5/1981 | Colder et al. | 102/275.3 X |
| 3,451,341 | 6/1969 | Dittmann | 102/318 |
| 3,709,149 | 1/1973 | Driscoll | 102/312 |
| 3,987,733 | 10/1976 | Spraggs et al. | 102/275.3 X |
| 4,060,033 | 11/1977 | Postopack et al. | 102/318 |
| 4,165,691 | 8/1979 | Bowman et al. | 102/322 |
| 4,178,852 | 12/1979 | Smith et al. | 102/322 |
| 4,295,424 | 10/1981 | Smith et al. | 102/320 X |
| 4,324,183 | 4/1982 | Prahouser et al. | 102/275.3 X |
| 4,334,476 | 6/1982 | Day et al. | 102/331 X |
| 4,350,097 | 9/1982 | Bowman et al. | 102/275.3 X |
| 4,383,484 | 5/1983 | Morrey | 102/275.12 X |
| 4,527,482 | 7/1985 | Hynes | 102/313 X |
| 4,539,909 | 9/1985 | Day et al. | 102/275.4 X |
| 4,637,312 | 1/1987 | Adams et al. | 102/275.5 X |

*Primary Examiner*—David H. Brown

*Attorney, Agent, or Firm*—Diamond C. Ascani

[57] ABSTRACT

An explosive primer unit adapted to be initiated instantaneously by low energy detonating cord when the unit comprises an explosive primer and an explosive coupler which operatively joins the low energy detonating cord to the primer.

18 Claims, 3 Drawing Sheets

EXPLOSIVE PRIMER UNIT FOR INSTANTANEOUS INITIATION BY LOW-ENERGY DETONATING CORD

BACKGROUND OF THE INVENTION

1. Field of the Invention

The invention relates to an explosive primer unit adapted to be initiated instantaneously by low-energy detonating cord (LEDC).

2. Description of the Prior Art

Blasting operations in which a cap-insensitive explosive is to be initiated non-electrically in a borehole usually are carried out with a cap-sensitive high-energy primer together with a high-energy detonating cord to initiate the primer when instantaneous initiation in the hole is required. The cord normally is threaded through a cord tunnel in the primer, a knot made in the cord to secure the primer on the cord, and the primer lowered into the hole by means of the cord. Multiple primers may be threaded onto a single length of cord and positioned at different depths in the hole.

High-energy detonating cords have an explosive core loading greater than 2 grams per meter, the cords most commonly used for the instantaneous initiation of primers having core loadings of 10 grams per meter. Cords of this size are disadvantageous, however, not only on the basis of cost, but also because the high noise levels associated with their use is objectionable in many locations. The use of high-energy detonating cords to initiate multiple primers instantaneously in a decked hole at delay intervals provided at the surface of the hole also is difficult to manage because, when two or more high-energy cords are used as downlines in such a situation, the detonation of one of the cords may initiate other cords instantaneously, thus overriding the surface delay timing imposed on the other downlines. Multiple downlines of high-energy detonating cord may be used successfully with surface delays only in holes of sufficiently large diameter and provided that extreme care is taken to keep the cords sufficiently separated from one another. Also, such decked holes should be initiated bottom deck first and upper decks consecutively in sequence.

Low-energy detonating cord (LEDC), having an explosive core loading of only about 0.02 to 2 grams per linear meter of cord length, overcomes the problems of noise, high brisance and initiating each other associated with the above-described high-energy cord. LEDC downlines heretofore have been employed in conjunction with high-energy primer or booster units containing a percussion-actuated detonator, e.g., in the delay booster assembly described in U.S. Pat. No. 3,709,149, issued Jan. 9, 1973, to H. E. Driscoll. Co-pending, co-assigned U.S. patent application Ser. No. 714,505, filed Mar. 25, 1985, by M. E. Yunan, describes a primer assembly which includes a percussion-actuated detonator seated in a cavity in a high-energy primer, and an explosive coupler for explosively coupling the detonator to LEDC which is to be threaded through a perforation in the primer. This assembly, when incorporating a delay detonator, can be used in an in-hole delay system for the delayed initiation of deck-loaded explosive charges with high-energy delay primers strung on a single LEDC downline. However, for the instantaneous initiation of a primer with an LEDC downline, a less complex primer assembly which still affords the reliable initiation of the primer explosive by the low-energy cord would be desirable.

SUMMARY OF INVENTION

The present invention provides, an explosive primer unit adapted to be threaded onto, and initiated instantaneously by, low-energy detonating cord (LEDC), the primer unit comprising:

(a) a substantially cylindrical high-energy explosive primer, e.g., a cast primer, having a cord-receiving perforation therein substantially on or parallel to its cylindrical axis and extending from one of its ends to the other; and (b) attached to an end surface of the cylindrical primer, an arming element comprising an explosive coupler that contains (1) a coupling charge of granular detonating explosive in linear array in a sealed bore therein, and (2) a means for manually disengaging the element from the primer should disarming become advisable at any time before loading The bore and the linearly arrayed coupling charge are substantially perpendicular to the cord-receiving perforation in the explosive primer, and the coupling charge, at least in an end segment of the linear array which is nearer to the cord-receiving perforation, is shock-sensitive and in close enough proximity to the cord-receiving perforation to be initiated by the detonation of LEDC threaded through the perforation. Also, the coupling charge, or at least one segment thereof, is a granular high-velocity detonating explosive, e.g., pentaerythritol tetranitrate (PETN), capable of initiating the primer along the surfaces adjacent thereto.

In a preferred primer unit, one of the end surfaces of the explosive primer is provided with a recess in communication with, and having a longitudinal axis substantially perpendicular to, the cord-receiving perforation, and the explosive coupler is seated within the recess. This primer gives added protection to the more-sensitive explosive coupler against impact of the primer unit during handling and borehole loading operations.

A preferred explosive coupler, also provided by the invention, comprises a plastic connecting block having a bore which houses a coupling charge of granular detonating explosive in linear array, or which houses a metal capsule containing the coupling charge. The connecting block has a tab-like appendage on its exterior surface which is able to protrude from the end of the cylindrical primer when the coupler is seated in a recess therein.

BRIEF DESCRIPTION OF THE DRAWING

In the accompanying drawing, which illustrates specific embodiments of the primer unit and explosive coupler of the invention.

DETAILED DESCRIPTION

Figure 1:
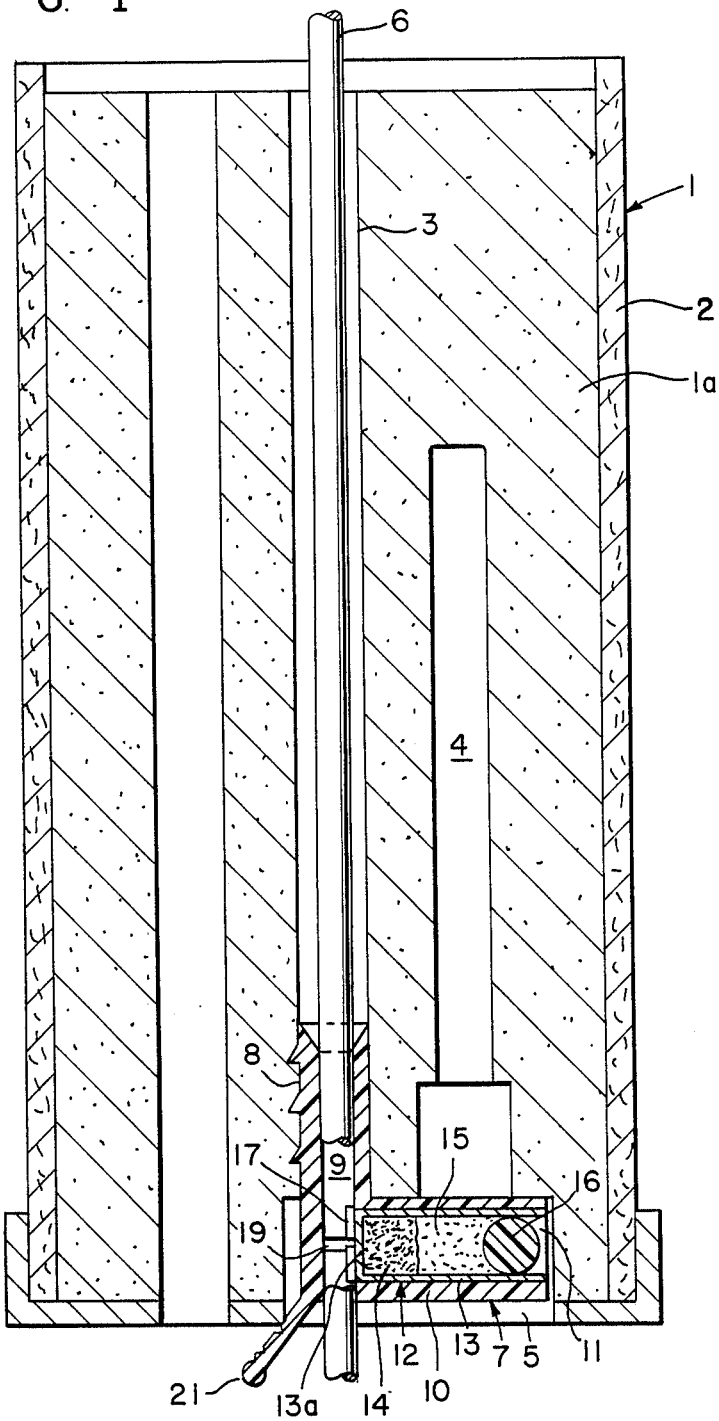
FIG. 1 is a cross-sectional view of a preferred primer unit of the invention threaded onto a length of low-energy detonating cord.

The primer unit of the invention contains (1) a high-energy explosive primer, i.e., a substantially cylindrical mass of explosive, usually a cast explosive, generally lightly wrapped with paper or cardboard, optionally end-capped, or held in a plastic container, and (2) as an arming eleaent for the primer, an explosive coupler, preferably an explosive-containing plastic connecting block, for coupling the primer to LEDC which is to be threaded through a perforation in the primer. A preferred primer unit is shown in FIG. 1. The explosive coupler of the FIG. 1 unit is depicted as a separate element in FIGS. 2 and 3.

In the primer unit shown in FIG. 1, 1 is a substantially cylindrical explosive primer unit, typically formed from a cast explosive 1*a* of the kind commonly used in high-energy primers. Primer 1 has a light peripheral wrap 2, e.g., a cardboard tube into which explosive Ia has been cast. Primer 1 has an aperture, or perforation 3 therethrough running coincident with, its longitudinal cylindrical axis. Perforation 3 allows LEDC 6 to be threaded through primer Unit 1.

Although not used in the present instantaneously initiated primer, cavity 4, separated from, and parallel to, perforation 3 is present in the primer shown in FIG. 1 to adapt it for use with a detonator as described in the aforementioned co-pending U.S. patent application Ser. No. 714,505, the disclosure of which is incorporated herein by reference. Recess 5, in an end surface of primer unit 1, is so conformed as to receive, together with perforation 3, an explosive coupler connecting block for explosively coupling a length of LEDC 6, threaded through perforation 3 of the primer unit 1.

Figure 2A:
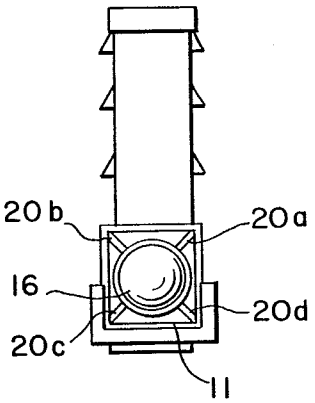
FIGS. 2A, 2B, and 2C are front, end, and top views, respectively, of the connecting block shown in FIG. 2.
Figure 2:
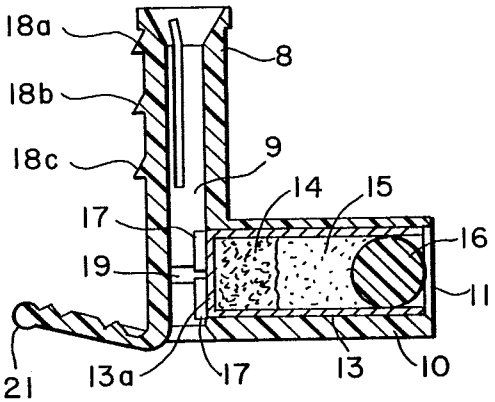
FIG. 2 is a cross-sectional view of the connecting block of the primer unit shown in FIG. 1.
Figure 2C:
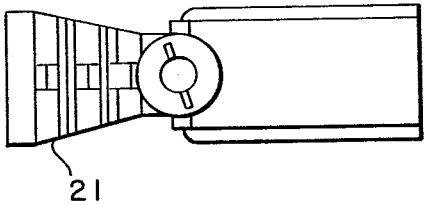
Figure 2B:
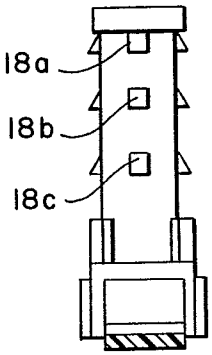

The aforementioned connecting block, denoted generally as 7, is a largely rigid plastic member having a substantially L-shaped configuration (see FIG. 2). One arm of the L, 8, of substantially tubular configuration, is inserted into perforation 3 in primer unit 1 (FIG. 1). Arm 8 has an open passageway 9 which communicates with perforation 3, thus allowing LEDC 6 to be threaded through perforation 3 when arm 8 is in place therein. The wall of arm 8 is provided with three rows of circumferential, appropriately angled spikes 18*a*, 18*b*, and 18*c*, which act as gripping means that allow arm or stem 8 to be inserted into perforation 3 and to grip into the surrounding wall of the primer, thus hindering the retraction of block 7 from primer unit 1 due to forces encountered when the primer unit is lowered into a hole. Disarming tab 21 is attached to the end of the arm 8. The other arm 10 of block 7, perpendicular to block-attaching arm 8, is the part of the explosive coupler which houses the coupling charge. Arm 10 has a square bore 11 in which explosive coupling element 12 is seated.

Coupling element 12 consists of shell 13, e.g., made of metal or plastic, integrally closed at one end 13*a* and containing an initiation charge 14 of a shock-sensitive granular detonating explosive, e.g., lead azide powder, adjacent end 13*a*. Adjacent charge 14, shell 13 contains a booster charge 15 of a granular high-velocity detonatinq explosive, e.g., PETN. The open end of shell 13 is sealed with a spherical plastic plug 16. Plug 16 may also be conical and pressed into shell 13 for sealing purposes as well. Circumferential crimps may or may not be used with cylindrical or conical plugs for added sealing effects.

As is shown in FIG. 1, coupling element 12 is seated in bore 11 of block arm 10. As can be seen from FIG. 2, bore 11 is partially closed by a pair of stop means I7, comprised of flat and tapered areas at the end of bore 11. Stop means or bore closure 17 is located adjacent to passageway 9. An opening or slot 19 is formed by stop means 17 and passageway 9. Thus, when shell 13 is pushed into bore 11 and comes to rest against stop means 17, its coined-bottom end 13*a* faces passageway 9 through the opening 19 in stop means 17.

Once coupling element 12 is seated in bore 11, connecting block 7 is ready to be positioned in primer unit 1. The block is pushed into recess 5, whereby arm 8 enters perforation 3. The block is permitted to abut the inner surface of recess 5. thereby placing block arm 10 essentially completely within the confines of recess 5, with tab 21 exposed. This allows the unit to be disarmed at any time by pulling tab 21.

When LEDC is threaded through perforation 3 and passageway 9 therein adjacent the bottom of explosive-containing shell 13, and the LEDC detonates, the detonation is picked up by initiation charge 14 and is transmitted directly and instantaneously to primer 1*a* via the detonation of booster charge 15. Thus, with one modification of the primer, i.e., the attachment of explosive coupler connecting block 7, which can be effected in the field at the time of use so that the primer can be transported unarmed, the primer is converted into the primer unit of the invention, ready for instantaneous initiation by LEDC.

The following examples are illustrative of a primer unit as shown in FIG. 1, and the functioning thereof.

(a) Primer 1*a* was a Du Pont HDP primer, a cast primer weighing 1.6 kg and detonating at a velocity of 6600 m/sec. Recess 5 was conformed and dimensioned so as to accommodate arm 10 of connecting block 7.

(b) Connecting block 7 was made of high-density polyethylene. Arms 8 and 10 were 2.9 cm and 2.5 cm long, respectively, inclusive of their overlapping portions. Bore 11 in arm 10 was a 0.78 cm square (FIG. 2A) with 4 longitudinal ribs 20*a*, 20*b*, 20*c* and 20*d* to produce effective diameters 20*a*–20*c* and 20*b*–20*d* of a circle 0.70 cm. The inner diameter of arm 8, i.e., the diameter of passageway 9, was 3.8 mm.

(c) Coupling element 12 consisted of a 20 mm long aluminum shell having a 6.5 mm inner diameter, a 7.3 mm outer diameter, and a coined integrally closed end, the thinned portion of the coined end being 0.13 mm thick and 4.6 mm in diameter. Dextrinated lead azide in the amount of 0.2 gram was loaded into the shell, followed by 0.5 gram of cap-grade PETN. A 6.9 mm diameter solid polyethylene sphere was used to seal the shell and press the explosive charges with a force of 1200–1500 Newtons. Coupling element 12 was seated in bore 11 abutting against the stop means 17 therein, thereby exposing the end of shell 13 to passageway 9.

With coupling element 12 in position in bore 11, connecting block 7 was placed in recess 5 and perforation 3 of primer 1 with arm 8 engaging the inside wall of the primer. A length of the LEDC described in Example 1 of U.S. Pat. No. 4,232,606 was threaded through perforation 3 and passageway 9 as shown. The LEDC was detonated by means of a No. 6 electric blasting cap having its end in coaxial abutment with an exposed end of the cord. The primer detonated instantaneously.

Similar results are obtained when connecting block 7 with coupling element 12 in position in bore 11. is attached to a primer that has no recess 5. In this case, the block is held with arm 10 against the end of the primer by the gripping means on arm 8 within perforation 3. This leaves coupler arm 10 outside the confines of the primer. Instantaneous detonation of the primer occurs in air and in water with 0.25 gram of PETN in the coupling charge (with the 0.2 gram lead azide) even when a 0.7 cm gap of air or water is present between the block and the primer end surface.

The L-shaped connecting block is especially useful with primers having no recessed end, the attaching arm or stem perpendicular to the coupler arm allowing attachment to the primer by gripping into the surrounding wall of the cord-receiving perforation in the primer. Primer units having the coupler arm of the connecting block outside the confines of the primer can have their resistance against damaging impact improved by a thicker wall on the connecting block, a rigid protective cover over the coupler end of the unit, or the like.

Figure 3:
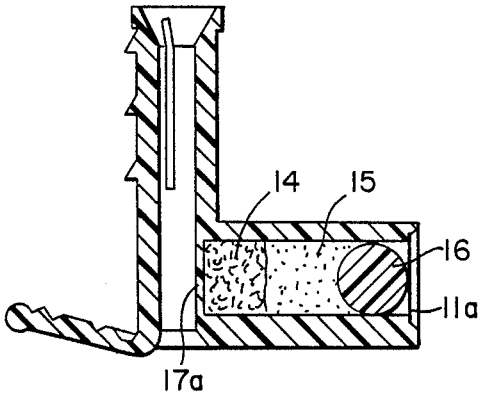
FIG. 3 is a cross-sectional view of a connecting block with its bore loaded directly with explosives.
Figure 3A:
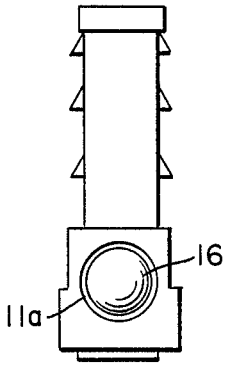
FIG. 3A is a front view of the connecting block shown in FIG. 3.

The low-energy detonating cord and the primer are operatively joined in the present primer unit by means of an explosive coupler in which a dual-purpose coupling charge (i.e., an initiation/booster charge) of granular detonating explosive is housed in linear array in a bore, preferably in a substantially tubular plastic connecting block that is attached to the primer so that the coupling charge is perpendicular to the cord and is adapted to pick up the detonation from the cord, boost the energy level of the detonation, and apply sufficient detonating force in a radial direction so as to initiate the adjacent primer explosive directly. The bore in the connecting block may be completely closed, e.g., by a thin plastic membrane, to permit the coupling charge to be loaded directly into the bore and retained therein, the location of the closure and the attachment of the block to the primer being such that the closure faces LEDC threaded through the cord-receiving perforation in the primer. In such a case the explosive-containing block is itself a coupling element. Such type of coupling element 12 is shown in FIGS. 3 and 3A where bore 11 is circular and terminated by a continuous film 17*a*. Shock-sensitive explosive 14 and high velocity explosive 15 are loaded and pressed separately or together with sealing ball 16. However, it is preferred that a self-contained coupling element, e.g., a sealed plastic or metal shell containing the coupling charge, be employed. Such an element is more readily adapted to production in commonly available loading equipment, and can be positioned in the connecting block to form the explosive coupler at the place of manufacture or in the field.

When the coupling charge is housed within a coupler shell that is integrally closed at one end and sealed at its opposite end with a plug, and the shell is to be seated within the bore in the connecting block, the bore is partially closed, e.g., narrowed or otherwise constricted as by projections or the like, or completely closed, as by a thin plastic membrane, so that the integrally closed end of the shell may rest against the resulting stop means, which will face the LEDC to be threaded through the cord-receiving perforation in the primer to which the block is to be attached. As a result, the coupling charge in the bore or in the shell may be positioned in close enough proximity to the LEDC as to be initiatable by the cord's detonation.

The connecting block is constructed from a thermoplastic or thermosetting plastic material. To protect the coupling charge from accidental detonation by impact if the primer unit should inadvertently be dropped through large distances with the coupler exposed, the plastic thickness of the block around the coupling charge should be at least about 1.5 mm.

The L-shaped connecting block for the coupler, shown in the drawing, contains an attaching arm in addition to the block-like portion which houses the coupling charge. In other embodiments, the arm L for attaching the coupler to the primer body may be omitted and the charge-housing portion used alone, with alternative means for holding the block in the recess in the primer, e.g., a tongue-in-groove connection.

The coupling charge, in at least the end-segment thereof which is nearer the cord-receiving perforation, is a shock-sensitive initiation charge, e.g., charge 14 in FIG. 1. At the same time, at least one segment of the coupling charge is a booster charge of granular high-velocity detonating explosive, e.g., charge 15 in FIG. 1. In cases in which the explosive core loading of the LEDC downline to be used to initiate the primer is at the lower end of the LEDC core loading range, e.g., below 1 g/m, a more sensitive explosive such as lead azide should be used to assure pick-up from the cord. This explosive will be used with a high-velocity booster charge such as PETN or RDX. When the LEDC has a higher loading, e.g., about 1 to 2 g/m, an all-PETN or all-RDX coupling charge may be used, as this charge may perform both pick-up and booster functions. The superfine or cap-grade form of these explosives may be used, with the more-sensitive superfine PETN or RDX being preferred at least in the end-segment of the coupling charge nearer the LEDC. A method of making superfine PETN is described in U.S. Pat. No. 3,754,061.

The present primer unit is adapted to be used in the priming of cap-insensitive explosives by the initiation impulse supplied by a low-energy detonating cord (LEDC) on which the primer unit is strung. The LEDC has a low enough explosive core loading, i.e., only up to about 2 g/m of cord length, that it does not directly initiate or disturb the explosive to be primed. At the same time, the side energy output of the detonating cord is sufficient to initiate the coupling charge adjacent thereto. A preferred cord is one described in U.S. Pat. No. 4,232,606, the disclosure of which is incorporated herein by reference. This cord has a solid core of a deformable bonded detonating explosive composition comprising a crystalline high explosive compound, preferably superfine PETN, admixed with a binding agent. The crystalline explosive loading of this cord should be at least about 0.1 g/m, a preferred loading being in the range of about from 0.2 to 1.0 g/m. The cord described in U.S. Pat. No. 3,125,024 also can be used, e.g., in a granular PETN core loading of about 0.7 to 1.0 g/m. LEDC in which a granular explosive core is confined in a metal tube also can be employed (U.S. Pat. No. 2,982,210).

I claim:

1. An explosive primer unit adapted to be threaded onto, and initiated instantaneously by, low-energy detonating cord (LEDC) and comprising:

(a) a substantially cylindrical high-energy explosive primer having a cord-receiving perforation therein substantially on or parallel to its cylindrical axis and extending from one of its ends to the other, and (b) attached to an end surface of said substantially cylindrical primer, an arming element comprising an explosive coupler that contains (1) a coupling charge of granular detonating explosive in linear array in a sealed bore therein, said bore and said linearly arrayed coupling charge being substantially perpendicular to the cord-receiving perforation in said explosive primer, said coupling charge being shock-sensitive and in close enough proximity to said cord-receiving perforation to be initiated by the detonation of the LEDC through the perforation, and said coupling charge being a high velocity explosive adapted to initiate said primer along the surfaces thereof adjacent thereto; and (2) a means for manually disengaging said arming element from said primer.

2. An explosive primer unit of claim 1 wherein said cord-receiving perforation lies substantially on the cylindrical axis of said primer.

3. An explosive primer unit of claim 2 wherein said primer has a recess in one of its end surfaces, said recess being in communication with, and having a longitudinal axis substantially perpendicular to, said cord-receiving perforation, and said arming element being seated within said recess.

4. An explosive primer unit of claim 3 wherein a cavity which is substantially parallel to, and separated form, said cord-receiving perforation in said explosive primer extends from said recess toward the opposite end surface of said primer, said cavity being empty when said arming element is in place in said recess.

5. An explosive primer unit of claim 3 wherein said explosive coupler comprises a plastic connecting block having a bore which houses said coupling charge.

6. An explosive primer unit of claim 5 wherein said connecting block is so configured and dimensioned as to be essentially fully accommodated by said recess.

7. An explosive primer unit of claim 5 Wherein said means for disengaging said arming element from said recess is a pull-tab appendage on the exterior surface of said connecting block, said appendage protruding from said recess when said explosive coupler is seated therein.

8. An explosive primer unit of claim 5 wherein said connecting block is a substantially L-shaped member having first and second perpendicular arms of substantially tubular configuration, said first arm constituting a means of attaching said block to said primer and having an open passageway adapted to have a low-energy detonating cord threaded therethrough, and said second arm housing said coupling charge in a bore therein, said first arm being adapted to be inserted into said cord-receiving perforation to provide the specified positioning of said explosive coupler with respect to LEDC when threaded through said perforation and passageway.

9. An explosive primer unit of claim 8 wherein the first arm of said L-shaped block is substantially tubular and is provided with gripping means on its external surface adapted to engage the explosive forming the wall of said cord-receiving perforation.

10. An explosive primer unit of claim 5 wherein said coupling charge is housed in said bore in a self-contained coupling element comprising a metal shell having an integrally closed end adjacent said cord-receiving perforation, and its opposite end sealed with a plug.

11. An explosive primer unit of claim 10 wherein said coupling charge is all-PETN or all-RDX.

12. An explosive primer unit of claim 10 wherein said coupling charge is a segmented charge and said shell contains, in sequence from said integrally closed end, a shock-sensitive initiation charge and a booster charge of high-velocity detonating explosive.

13. An explosive primer unit of claim 12 wherein said initiation charge is lead azide and said booster charge is pentaerythritol tetranitrate (PETN) or cyclotrimethylenetrinitramine (RDX).

14. An explosive coupler for arming a high-energy explosive primer to adapt it to be initiated instantaneously by low-energy detonating cord (LEDC), said coupler comprising:

(a) a plastic connecting block housing a coupling charge of granular detonating explosive in linear array in a sealed bore therein, said coupling charge being a high-velocity explosive adapted to initiate said primer along one or more of its surfaces, and said coupling charge also being shock-sensitive at least in an end segment of said linear array; and (b) a pull-tab appendage on the exterior surface of said connecting block.

15. An explosive coupler of claim 14 wherein said coupling charge is housed in said bore in a self-contained coupling element comprising a metal shell having an integrally closed end and its opposite end sealed with a plug.

16. An explosive coupler of claim 15 wherein said coupling charge is all-PETN or all-RDX.

17. An explosive coupler of claim 15 wherein said coupling charge is a segmented charge and said shell contains, in sequence from said integrally closed end, a shock-sensitive initiation charge and a booster charge of high-velocity detonating explosive.

18. An explosive coupler of claim 17 wherein said initiation charge is lead azide and said booster charge is PETN or RDX.

* * * * *